United States Patent [19]

Matsumoto et al.

[11] 4,120,159

[45] Oct. 17, 1978

[54] STEAM TURBINE CONTROL SYSTEM AND METHOD OF CONTROLLING THE RATIO OF STEAM FLOW BETWEEN UNDER FULL-ARC ADMISSION MODE AND UNDER PARTIAL-ARC ADMISSION MODE

[75] Inventors: Hiroshi Matsumoto; Yoshiyuki Nakano; Toshihiko Higashi; Akihiro Yasumoto, all of Ibaraki, Japan

[73] Assignee: Hitachi, Ltd., Japan

[21] Appl. No.: 734,017

[22] Filed: Oct. 19, 1976

[30] Foreign Application Priority Data

Oct. 22, 1975 [JP] Japan ..... 50-126398
Mar. 26, 1976 [JP] Japan ..... 51-32615

[51] Int. Cl.[2] ..... F22D 1/12

[52] U.S. Cl. ..... 60/667; 415/17; 290/40 C; 364/494

[58] Field of Search ..... 60/660, 661, 664, 665, 60/667; 415/1, 17; 290/40 R, 40 C; 235/151.1; 364/494, 499

[56] References Cited

U.S. PATENT DOCUMENTS

| | | | |
|---|---|---|---|
| 3,097,489 | 7/1963 | Eggenberger et al. | 60/660 X |
| 3,561,216 | 2/1971 | Moore | 364/494 X |
| 3,723,018 | 3/1973 | Uchiyama et al. | 415/1 X |
| 3,956,897 | 5/1976 | Zitelli et al. | 60/660 |

FOREIGN PATENT DOCUMENTS

| | | | |
|---|---|---|---|
| 445,193 | 1/1974 | Australia | 60/660 |

*Primary Examiner*—Allen M. Ostrager
*Assistant Examiner*—Stephen F. Husar
*Attorney, Agent, or Firm*—Craig & Antonelli

[57] ABSTRACT

In a steam turbine-generator with means for determining a load demand signal in accordance with a load reference signal, means for determining the valve opening under each admission mode of full-arc and partial-arc in accordance with said load demand signal and means for adjusting the ratio between valve openings under the each admission mode in accordance with a load change the ratio of steam flow under each of the admission modes is controlled in accordance with a load change so as to minimize the thermal stresses and thereby reduce the turbine load changing time.

8 Claims, 13 Drawing Figures

FIG. 4a
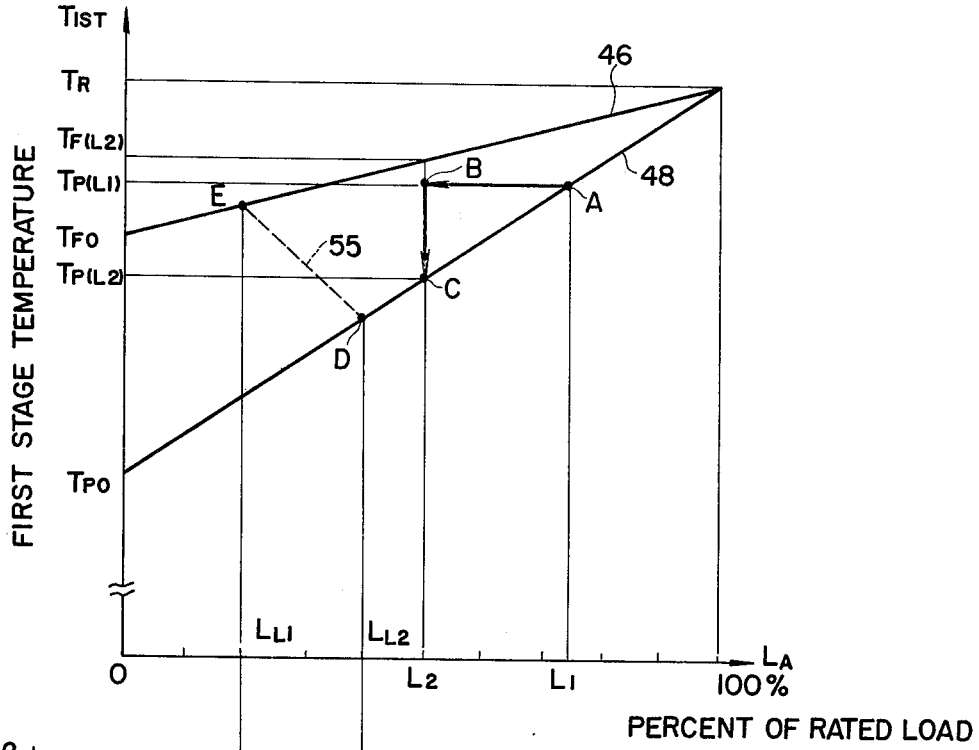
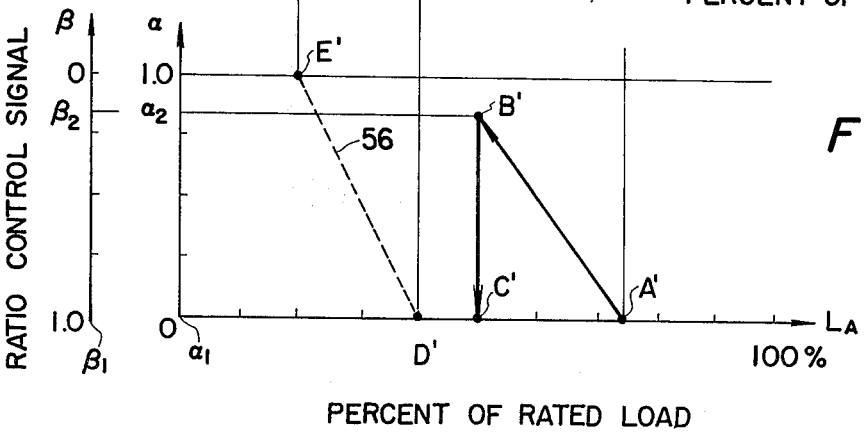
FIG. 4b

STEAM TURBINE CONTROL SYSTEM AND METHOD OF CONTROLLING THE RATIO OF STEAM FLOW BETWEEN UNDER FULL-ARC ADMISSION MODE AND UNDER PARTIAL-ARC ADMISSION MODE

BACKGROUND OF THE INVENTION

This invention relates to the rapid loading and unloading of steam turbine-generators in accordance with the calculated ratio of steam flows under two types of steam admission in a manner to minimize the thermal stresses in order to reduce the turbine load changing time.

Startup and loading of a large steam turbine-generator has become more involved in recent years, as the trend toward larger units results in higher thermal stresses for any given temperature transient. Two factors contribute to thermal stresses during start up. Initially, a mismatch exists between the temperature of the admitted steam and the metal temperature and the degree of mis-match depends upon the past operating history, i.e., whether or not the turbine is involved in a cold start or a hot start. The mis-match is essentially corrected during the acceleration phase of the startup.

Secondly, when the turbine-generator is producing load and steam flow is high enough so that any substantial mis-match cannot exist, the metal temperature will follow steam temperatures closely. Control of metal temperatures and therefore thermal stresses is based primarily on analytical and statistical correlation between stress levels and expected rotor life.

Traditionally, charts and graphs have been provided to allow the operator to reduce the mis-match at a safe rate during the acceleration phase of the startup and to determine allowable rates of change of metal temperature during the loading procedure. Various techniques have been employed to speed up the process of loading the turbine, including heat soaking periods on "turning gear" to reduce the initial mis-match. Initial operation in the less efficient "full-arc" steam admission mode has been used to achieve uniform warming of the high pressure turbine inlet parts.

There have been suggestions in the published prior art of starting up steam turbines using various techniques such as acceleration control, load control, etc. in an effort to minimize startup time without damaging the turbine. These systems are usually predicated on ideal steam generator conditions. Since turbine startups can take several hours, systems which will reduce these times, as well as allow for fluctuations in steam temperature and pressure from the steam generator, are of great value.

A sophisticated approach to startup and loading control by means of continuously calculating rotor surface and bore stresses from speed and temperature measurements, and then loading at a maximum permissible stress are described in U.S. Pat. No. 3,446,224 issued on May 27, 1969 U.S. Pat. No. 3,561,216 issued on Feb. 9, 1971, U.S. Pat. No. 3,588,265 issued on June 28, 1971, and U.S. Pat. No. 3,928,972 issued on Dec. 30, 1975 etc.. Although these patents are useful for achieving rapid startup and loading, from the standpoint of the delay time involved in the generation of thermal stresses, the above teachings are not always satisfactory because in effect the turbine is essentially controlled while monitoring the thermal stress produced in the turbine rotor.

SUMMARY OF THE INVENTION

An object of this invention, accordingly, is to provide a steam turbine control system, which seeks to substantially reduce or eliminate the generation of thermal stress in the turbine rotor.

Another object of the invention is to provide a steam turbine control system, which makes it possible to provide necessary signals to a steam generator control device so as to prevent generation of thermal stress in the turbine rotor that may otherwise occur with fluctuations in steam temperature supplied to the turbine.

The invention is based on the fact that the steam temperature, when steam is admitted into the turbine, varies with the steam admission mode, and it seeks to control the ratio of steam flow according to load change under each of the modes, namely full-arc admission mode and partial-arc admission mode, thereby permitting load changing without changing the steam temperature and hence without causing generation of thermal stress in the turbine rotor.

BRIEF EXPLANATION OF THE DRAWINGS

FIGS. 4*a* and 4*b* are graphs of load vs temperature and load vs ratio control signal under full arc and partial arc conditions carrying out the invention;

Figure 1:
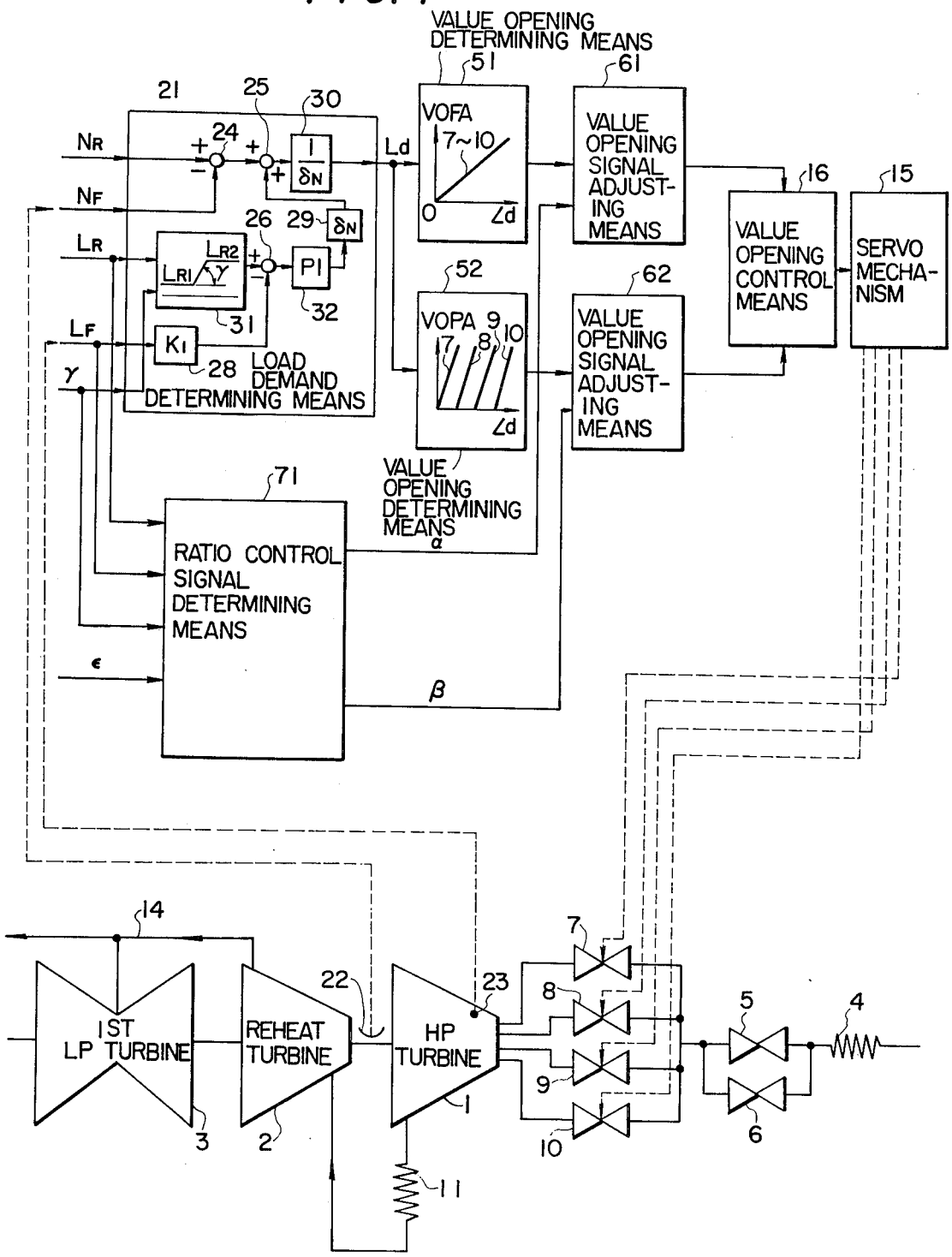
FIG. 1 is a simplified schematic diagram of a control system for carrying out the invention.

DETAILED DESCRIPTION OF THE PREFERRED EMBODIMENT:

Referring to FIG. 1 of the drawing, a schematic diagram shows portions of a reheat steam turbine, its normal speed and load control system, and an automatic ratio-adjusted loading system depicted in functional diagrammatic form. It will be understood by those skilled in the art that a large steam turbine-generator control and supervisory system is a very complex affair, and hence only the portions which are material to the present invention are shown here.

Portions of the turbine shown include a high pressure turbine 1, reheat turbine 2, and one of the double-flow low pressure turbines 3, all arranged in tandem. The number and arrangement of additional low pressure turbines, or perhaps additional reheat turbines, as well as, the number and arrangement of generators, are not important to an understanding of the invention. The steam flow is from a steam generator 4 through main stop valves 5 with built in bypass valves 6, and then through control valves 7, 8, 9, and 10, each of the latter connected to a different nozzle arc supplying the first stage of the high pressure rotor blades. Steam from the high pressure turbine 1 is reheated in reheater 11, flows through reheat stop valves (not shown) and intercept valves (not shown) to the reheat turbine 2, and thence through suitable crossover conduits 14 to the low pressure turbines.

The admission of steam is controlled through a number of control valve servo mechanisms shown collectively as 15 and operating the respective valves as indicated by dotted lines. The servo mechanisms may be of the electrohydraulic type driving high pressure hydraulic rams in response to electrical signals as is well known.

The servo mechanism 15 is under the control of a valve opening control means 16 which provides as its output a suitable valve positioning signal corresponding to a desired rate of steam flow.

As is known to those skilled in the art, the control valves 7–10 may be manipulated in such a way as to either admit steam uniformly through all of the nozzle arcs disposed around the first stage inlet of the turbine, otherwise known as "full arc" admission; or else the control valves 7–10 can be manipulated in sequence in a thermodynamically more efficient mode to one nozzle arc at a time, this being known as "partial arc" admission.

Figure 2A:
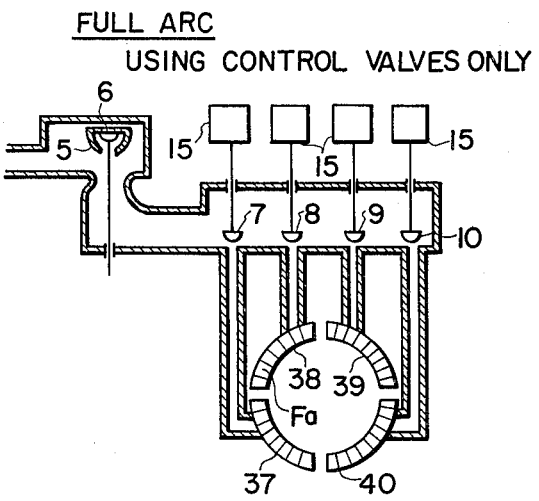
FIGS. 2*a* and 2*b* are simplified schematic diagrams illustrating admission modes using a control valves only.
Figure 2B:
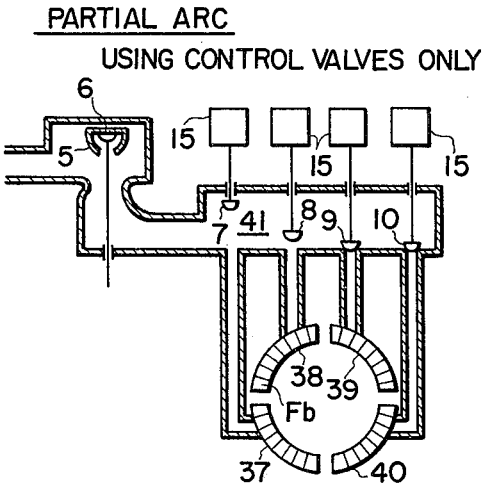

Reference to FIGS. 2*a* and 2*b* show the two extreme positions between full arc in FIG. 2*a* and partial arc in FIG. 2*b* when the control valves are used and therefore the stop valve 5 and its bypass 6 are open. Each of the control valves 7–10 supplies a separate nozzle arc 37–40 respectively. In FIG. 2*a*, all control valves 7–10 are partially open admitting steam to all nozzle arcs 37–40. In FIG. 2*b*, the first control valve 7 is wide open admitting steam to nozzle arc 37, while control valve 8 is partially open admitting reduced flow of steam to nozzle arc 38. Valves 9 and 10 are closed so that nozzle arcs 39, 40 are blocked off.

Figure 3:
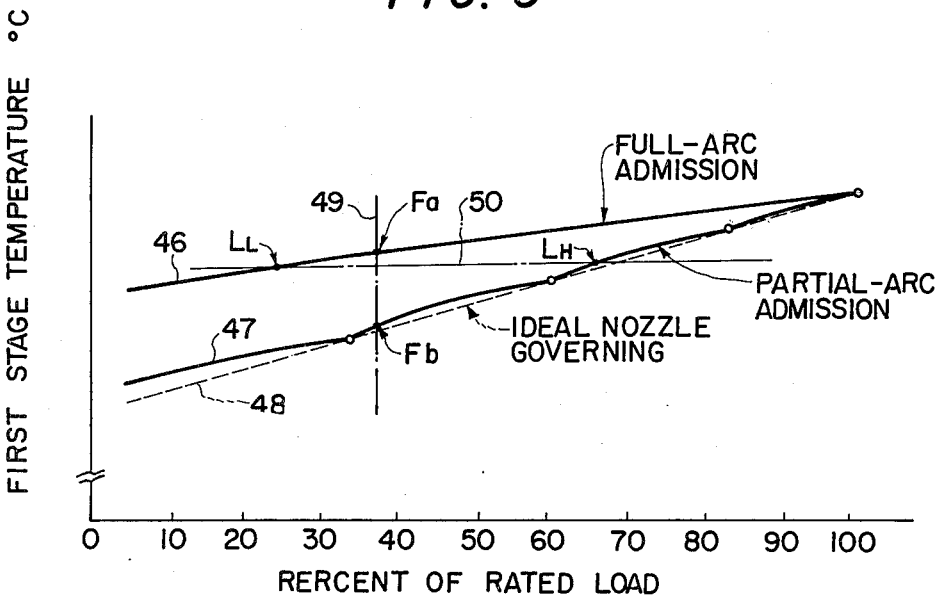
FIG. 3 is a graph of load vs temperature under both full arc and partial arc conditions.

Reference to FIG. 3 of the drawing illustrates that the first stage temperature difference exists over practically the entire range of rated load, being maximum at no load, and converging to an identical temperature at full load. At full load, there is no distinction between full arc and partial arc modes.

In FIG. 3, the top line segment 46 (full arc) shows a gradually increasing first stage temperature with increase in load. Below, the connected arcuate line segments 47 (partial arc) show a more pronounced increase in temperature with increase in load but commencing at a lower temperature. The discontinuities indicate the points where each of the four control valves commence to open. Theoretical operation with an infinite number of valves is indicated by the dashed line 48.

The vertical line 49 on FIG. 3 indicates that at a point Fa on full arc admission, a high first stage temperature is obtained, while at the same load at a point Fb on partial arc admission, a much lower first stage temperature is obtained. The horizontal line 50 in FIG. 3 indicates that at a point LL on full arc admission, a small load is obtained, while at the same first stage temperature at point $L_H$ on partial arc admission, a much larger load is obtained.

When a load change occurs, therefore, the first stage temperature is not changed by adequately controlling the ratio between the full arc admission and the partial arc admission. In view of this aspect, the invention contemplates to control, at the time of a load change, the steam flow in correspondence to the load change while controlling the ratio between full arc admission and partial arc admission so that the first stage temperature is not changed and gradually proceeds to the partial admission mode which is more efficient after completion of load change. Of course, for load increase after completion of transition to the partial arc admission mode the steam flow is increased under this mode at a predetermined rate of change since the temperature control of the first stage temperature can no longer be obtained through control of the admission mode ratio. Thus, according to the invention it is possible to realize load control which is essentially free from generation of thermal stress without need of monitoring or supervision of thermal stress.

In short, contrary to the teachings of the prior art, wherein governing was to take place either at full arc or at partial arc, the present invention contemplates continuous controlling between full and partial arc or at any intermediate point during transient operation in order to control first stage temperature to minimize the thermal stress occurrence. During constant load operation, control is gradually returned to the more efficient partial arc admission.

The various functions indicated in the FIG. 1 can be carried out by suitable hardware selected to carry out the indicated functions, or the functions can also be programmed as instructions to a digital computer.

In the first place, the invention as carried out by means of suitable hardware will be described in conjunction with FIG. 1, and then a description of an example of flow chart programming for carrying out the invention with a digital computer will be given.

In FIG. 1, designated at 21 is a load demand determining means, to which a speed reference signal $N_R$, a speed feedback signal $N_F$, a load reference signal $L_R$, a load feedback signal $L_F$ and a load change rate signal $\gamma$ are coupled to obtain a load demand signal $L_d$. The load demand signal $L_d$ increases or decreases upon alteration of the load reference signal $L_R$ from $L_{R1}$ to $L_{R2}$ depending upon the magnitude relation between $L_{R1}$ and $L_{R2}$, as given by $$L_d = L_{R1} \pm \gamma t + \frac{1}{\delta N}(N_R - N_F) \quad (1)$$

Of course, after $L_{R2}$ is reached by the load it is $$L_d = L_{R2} + \frac{1}{\delta N}(N_R - N_F) \quad (2)$$

where $\delta_N$ is the so-called speed regulation factor, i.e., a factor for converting the speed difference signal ($N_R - N_F$) into the corresponding load demand signal. In the instant embodiment, the speed feed-back signal $N_F$ and load feed-back signal $L_F$ are derived from the respective outputs of a speed detector and a first stage steam pressure detector, these detectors being schematically indicated at 22 and 23 respectively. In the means 21, designated at 24, 25 and 26 are adders, at 28, 29 and 30 coefficient multipliers, at 31 a pattern generator, and at 32 a proportional integrated controller. The individual adders receive their inputs of the illustrated polarities. Indicated at $K_1$ in the coefficient multiplier 28 is a coefficient for converting a pressure signal into a load signal. The pattern generator 31 has an integrating function and responds to changes of the load reference signal, that is, it follows the changes of the load reference signal at a specified load change rate $\gamma$.

Designated at 51 and 52 are respective valve opening determining means. The means 51 determines the openings of the control valves 7 to 10 with respect to the load demand signal $L_d$ in the full arc admission mode, while the means 52 similarly determines the openings of the control valves 7 to 10 in the partial arc admission mode. Of course, all the control valves 7 to 10 are positioned at the same opening in the full arc admission mode, while in the partial arc admission mode they are brought to the fully open position in sequence. Here, the valve opening is arranged to change as a linear function of the load demand signal $L_d$. This is done by so arranging a servo-mechanism as to make up for non-linear characteristics of the valves as is shown, for instance, in ISA Journal, September 1956, pages 323 through 329 "Control Valve Requirements for Gas Flow System". Designated at 61 and 62 are valve openings signal adjusting means which correct valve openings signals at respective admission modes provided from the respective valve opening determining means in the presence of ratio control signals $\alpha$ and $\beta$ to be described hereinafter. Here, $\alpha$ and $\beta$ are coefficients related to each other such that $\alpha + \beta = 1$ (provided $0 \leqq \alpha \leqq 1$ and $0 \leqq \beta \leqq 1$). More particularly, they are factors for making the ratio between steam flow in the full arc admission mode and that in the partial arc admission mode to be $\alpha$ and $\beta$ without changing the steam flow supplied to the turbine. The adjusting valve opening signals obtained from the respective valve opening signal adjusting means 61 and 62 are coupled to a valve opening control means 16, and thence they are given to the servo-mechanism for each of the valves 7 to 10 as a predetermined positioning signal for each valve.

Designated at 71 is a ratio control signal determining means for determining the steam flow ratio between the two admission modes. The load reference signal $L_R$, load feed-back signal $L_f$ and load change rate signal $\gamma$ and also a first stage temperature change rate signal $\epsilon$ are coupled to this means 71 to produce the ratio control signals $\alpha$ and $\beta$. The way of determining the ratio control signals $\alpha$ and $\beta$ will now be described with reference to FIGS. 4a and 4b, which are characteristic graphs for explaining the translation of $\alpha$ and $\beta$ respresenting the admission mode ratio when the load on the turbine in operation is changed from $L_1$ to $L_2$.

In FIG. 4a, when the turbine is in steady operation under load $L_1$, the admission mode is of course that of partial arc with higher efficiency and corresponds to point A in the Figure. At this time, $\alpha$ and $\beta$ showing the admission mode ratio are found at point A' in FIG. 4b. This means that $\alpha_1 = 0$ and $\beta_1 = 0.1$. According to the invention, as the load reference signal $L_R$ is changed from $L_1$ to $L_2$, the steam flow is controlled in such a fashion that both admission modes coexist, as shown at point B in FIG. 4a, whereby only the load is changed without causing changes in the first stage temperature. At this time, $\alpha$ and $\beta$ showing the admission mode ratio are found at point B' in FIG. 4b and are respectively $\alpha_2$ and $\beta_2$. Thereafter, only the admission mode ratio is controlled without causing load changes to eventually return to the sole partial arc. As a result, the operation is characteristically continued at point C in FIG. 4a and at point C' in FIG. 4b. Here, with the load change between points A and B (FIG. 4a) the admission mode is changed between points A' and B' (FIG. 4b). While in this case the temperature difference in the first stage temperature between the two admission modes, as indicated by lines 46 and 48, distributes itself according to the steam flow ratio between the two admission modes, this relation is practically linear; by setting $\alpha : \beta = 0.5 : 0.5$ the first stage temperature is found just mid way between the lines 46 and 48. Thus, the admission mode ratio control signals $\alpha$ and $\beta$ at the time of load change in FIG. 4a are calculated in the following manner.

Since the characteristics 46 and 48 can be regarded practically as straight lines, the first stage temperatures $T_F(L_A)$ and $T_P(L_A)$ in the respective full-arc and partial-arc modes at a given load $L_A$ (%) are given as $$T_F(L_A) = (T_R - T_{F0})\frac{L_A}{100} + T_{F0} \tag{3}$$

and $$T_P(L_A) = (T_R - T_{P0})\frac{L_A}{100} + T_{P0} \tag{4}$$

where $T_R$ is the first stage temperature under the rated load, $T_{FO}$ is the first stage temperature under no load at full-arc admission mode, and $T_{PO}$ is the first stage temperature under the no load at partial-arc admission mode.

Thus, when the turbine is under load $L_1$ (%) and operated at point A, the first stage temperature is obtained as $T_P(L_1)$ from equation (4). Immediately after change of load from $L_1$ (%) to $L_2$ (%) the first stage temperature is unchanged, and at this time $\alpha_2$ and $\beta_2$ showing the ratio between the two admission modes are as follows.

$$T_P(L_2) + \alpha_2\{T_F(L_2) - T_P(L_2)\} = T_P(L_1)$$

$$\alpha_2 = \frac{T_P(L_1) - T_P(L_2)}{T_F(L_2) - T_P(L_2)} \tag{5}$$

$$\beta_2 = 1 - \alpha_2 \tag{6}$$

$L_2$ here is obtained from the load reference signal and $L_1$ from the load feed-back signal, so that the first stage temperature in each admission mode under each load is obtained from equations (3) and (4) by using $T_R$, $T_{PO}$ and $T_{FO}$ which are stored as respective constants in the means.

Next, the rate of change of $\alpha$ and $\beta$ for correcting the admission mode ratio from $\alpha = \alpha_1 (= 0)$ to $\alpha = \alpha_2$ in accordance with the load change rate signal $\gamma$ is obtained. The increment $\Delta\alpha$ of ratio control signal $\alpha$ between the points A and B is $$\Delta\alpha = \alpha_2 - \alpha_1 \tag{7}$$

The period $\Delta T$ required for load change from $L_1$ to $L_2$ is $$\Delta T = \left|\frac{L_1 - L_2}{\gamma}\right| \tag{8}$$

Thus, the rate of change $(d\alpha/dt)_1$ of the ratio control signal $\alpha$ is $$\left(\frac{d\alpha}{dt}\right)_1 = \frac{\Delta\alpha}{\Delta T} = \left|\frac{\gamma}{L_1 - L_2}\right| \times (\alpha_2 - \alpha_1) \quad (9)$$

Consequently, where the control is made by means of special hardware as is illustrated, the outputs $\alpha$ and $\beta$ of the ratio control signal determining means are $$\alpha = \alpha_1 + \left(\frac{d\alpha}{dt}\right)_1 t \quad (10)$$

and $$\beta = 1 - \alpha = 1 - \alpha_1 - \left(\frac{d\alpha}{dt}\right)_1 t \cdot$$

$$= \beta_1 - \left(\frac{d\alpha}{dt}\right)_1 t \quad (11)$$

where $\alpha_1$ and $\beta_1$ are ratio control signals before the commencement of load change, and $t$ is the period elapsed from the start of load change. Of course, where the control system is realized with a digital computer the control is not continuous but is carried out at a predetermined cycle. In this case, by denoting the control cycle by $\tau$ we have $$\alpha(t) = \alpha(t - \tau) + \left(\frac{d\alpha}{dt}\right)_i \tau \quad (10)$$

$$\beta(t) = \beta(t - \tau) - \left(\frac{d\alpha}{dt}\right)_i \tau \quad (11)$$

for $\alpha$ and $\beta$, these equations (10)' and (11)' corresponding to the respective equations (10) and (11).

It will be appreciated that according to the invention the ratio of steam flow between full-arc and partial-arc admissions is controlled to permit load control without causing changes in first stage temperature, thus permitting the turbine load control without essentially causing the generation of thermal stresses. Thus, when the load has to be quickly reduced, this can be effected without essentially being accompanied by thermal stress generation even with a large load change rate signal.

After the load has stabilized at $L_2$, the ratio control signals $\alpha$ and $\beta$ are controlled to recover point C' from point B' in FIG. 4*b* for recovering point C from point B in FIG. 4*a*. At this time, it is necessary to detect the completion of load change, and this is done by determining that the difference between the load reference signal $L_R$ and the load feed-back signal $L_F$ is reduced to be within a predetermined range $\Delta L$; stated mathematically $$|L_R - L_F| \leqq \Delta L \quad (12)$$

When this condition is met, the ratio control signals $\alpha$ and $\beta$ are changed so as to commence transition into the partial arc admission mode. The ratio control signals $\alpha$ and $\beta$ are changed such that the first stage temperature change rate signal $\epsilon$ preset by taking thermal stress given to the turbine rotor into considerations is not exceeded, whereby the time $\alpha T'$ required for transition from point B to point C is given as $$\epsilon \cdot \Delta T = T_f(L_1) - T_f(L_2)$$

$$\text{Hence } \Delta T = \frac{T_f(L_1) - T_f(L_2)}{\epsilon} \quad (13)$$

Thus, the rate of change $(d\alpha/dt)_2$ of the ratio control signal $\alpha$ is $$\Delta T' \cdot \left(\frac{d\alpha}{dt}\right)_2 = \alpha_2$$

$$\text{Hence } \left(\frac{d\alpha}{dt}\right)_2 = \frac{\alpha_2}{\Delta T'} = \frac{\epsilon \cdot \alpha_2}{T_f(L_1) - T_f(L_2)} \quad (14)$$

Consequently, like equations (10) and (11) or equations (10)' and (11)' the ratio control signals $\alpha$ and $\beta$ for bringing about transition from point B to point C are $$\alpha = \alpha_2 + \left(\frac{d\alpha}{dt}\right)_2 \cdot t \quad (15)$$

$$\beta = 1 - \alpha = 1 - \alpha_2 - \left(\frac{d\alpha}{dt}\right)_2 \cdot t \quad (16)$$

$$\alpha(t) = \alpha(t - \tau) + \left(\frac{d\alpha}{dt}\right)_2 \tau \quad (15)'$$

$$\beta(t) = 1 - \alpha(t - \tau) - \left(\frac{d\alpha}{dt}\right)_2 \tau \quad (16)'$$

When $\alpha < 0$, the ratio control signal$\alpha$ may be limited to $\alpha = 0$ and $\beta = 1$, while when $\alpha > 1$ it may be limited to $\alpha = 1$ and $\beta = 0$. Also, since operation in the partial-arc admission mode under a low load is liable to result in local heating of the turbine, it is desirable to exclude the turbine operation mode from the region on the left hand side of the dotted line 55 connecting points D and E in FIG. 4a, that is, to avoid the presence of the ratio control signals $\alpha$ and $\beta$ in the region on the left hand side of the dotted line 56 connecting points D' and E' shown in FIG. 4*b*, and if intrusion into this region is likely, the ratio control signal $\alpha$ is desirably limited in the following way. Namely, denoting the loads at the points D and E by $L_{L2}$ and $L_{L1}$ respectively, the ratio control signal $\alpha$ is limited to $\alpha_L$, that is, $$\alpha = \frac{L_{L2} - L_R}{L_{L2} - L_{L1}} = \alpha < \quad (17)$$

if $L_{L1} < L_R < L_{L2}$, while limiting it to $\alpha = 1$ if $L_R \leqq L_{L1}$. In other words, the ratio control signal determining means 71 is arranged such that it also calculates the limit in equation (17) in addition to those in equations (10) and (11) or equations (15) and (16) so that these limited values of ratio control signal $\alpha$ may be selectively provided in accordance with the turbine operating conditions.

Now, a more practical contrivance of the invention will be discussed. The preceding embodiment presents no particular problem insofar as the turbine operation mode can be shifted horizontally, i.e., in the direction parallel to the abscissa in FIG. 4*a*, such as from point A to point B, when a load change is demanded. However, if it is inevitable to effect transition along the line 46, 48 or 55 for a load change, for instance when reducing the load from the rated load or reducing the load down to the region on the left hand side of the line 55 or increasing the load from point C to point A, generation of thermal stress is essentially inevitable. In view of this aspect, it is necessary to prepare optimum load change rate signals $\gamma_1$ to $\Gamma_n$ for the individual cases and select them to provide as in FIG. 1 in accordance with the turbine operating conditions.

Figure 5:
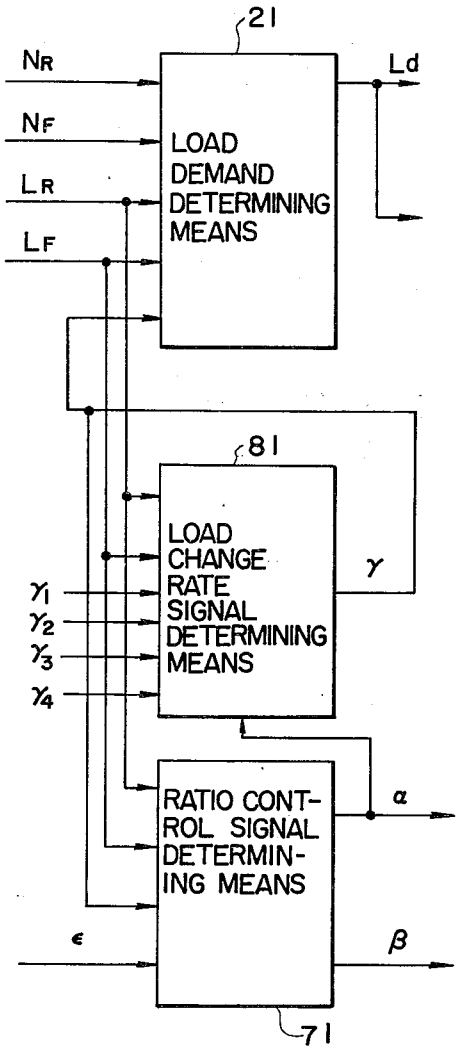
FIG. 5 is a simplified schematic diagram of part of another embodiment of the invention shown in correspondence to FIG. 1.

FIG. 5 is a schematic diagram similar to FIG. 1 but showing a load change rate signal determining means 81 which is particularly added to this end. This means 81 receives load reference signal $L_R$, load feed-back signal $L_F$ and ratio control signal from the means 71 to determine the turbine operating condition through its logic circuitry, and it selectively provides one of the prepared load change rate signals $\gamma_1$ to $\gamma_4$ that corresponds to the operating condition. The load change rate signal $\gamma_1$ is prepared for locus of first stage temperature in the direction parallel to the abscissa in FIG. 4a with load change, the signal $\gamma_2$ for locus along the line 46, the signal $\gamma_3$ for locus along the line 55, and the signal $\gamma_4$ for locus along the line 48. Of course, it is possible to arrange such that separately prepared $\gamma$ may be selected from the outside by ignoring $\gamma$ selected through the logic in FIG. 6 to thereby specify desired $\gamma$ at any time.

Figure 7:
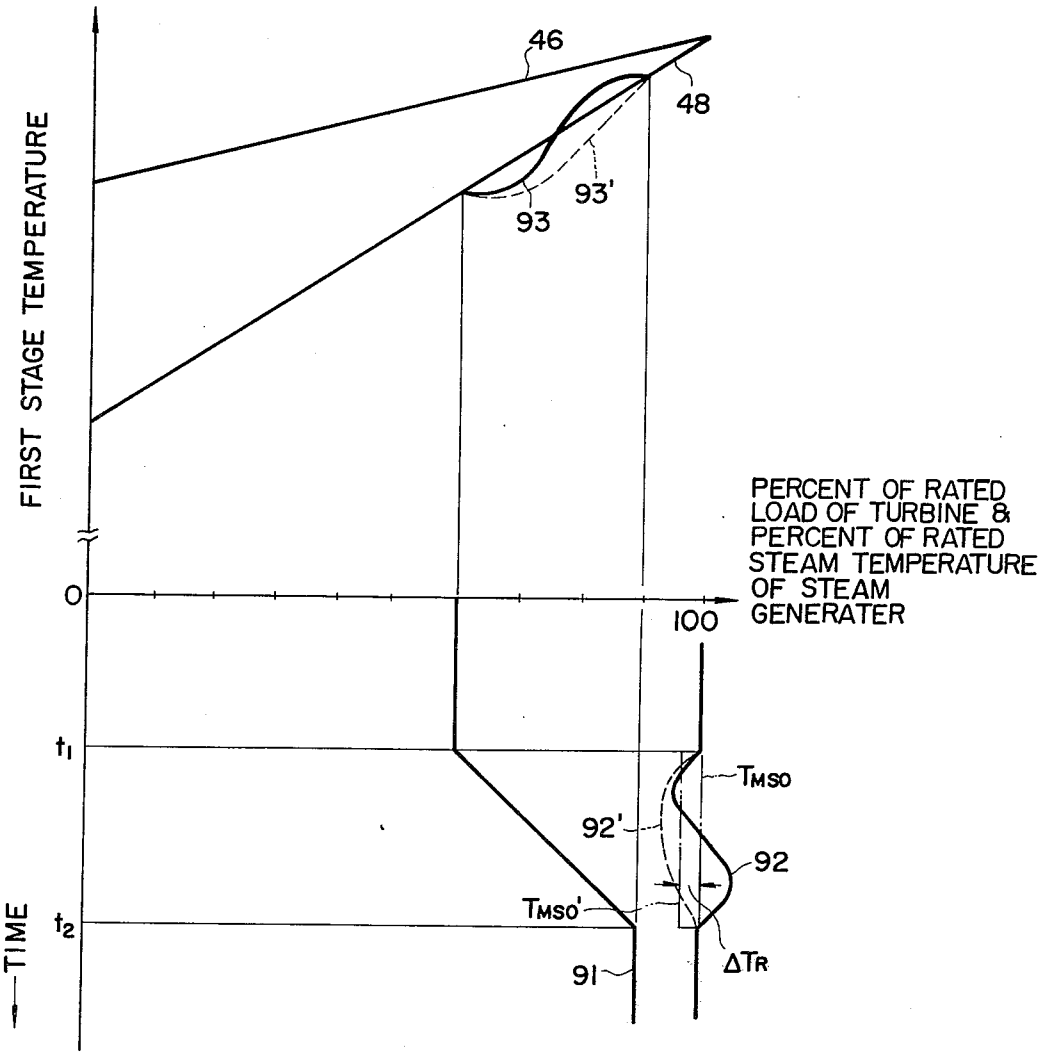
FIG. 7 is a graph illustrating variation of steam temperature of steam generator and accompanying variation of first stage temperature as the turbine load is changed in course of time.

A further embodiment of the invention, which is developed to include control in co-operation with the steam generator 4, will now be discussed. While the description so far has been based upon the assumption that the steam temperature supplied by the steam generator 4 is constant, the steam temperature actually fluctuates due to various external disturbances affecting the steam generator. Although various control means have been proposed for the control of the steam generator itself, more or less fluctuations inevitably take place in practice. FIG. 7 shows characteristics involved in the problem presented in this case and a more sophisticated measure to cope with it by a further embodiment of the invention. In this graph, the abscissa is taken for percent of rated load of the turbine and also for percent of rated steam temperature of the steam generator while taking the ordinate portion below the abscissa for time and that above the abscissa for first stage temperature. The graph shows that varying the turbine load from 60% to 90% of rated load during a period from instant $t_1$ till instant $t_2$ causes variation of steam temperature of the steam generator within ±5%. of rated temperature $T_{MSO}$ as indicated by line 92, thus varying the first stage temperature in a manner as indicated by line 93. However, variation as given by the line 93 is not desired because the thermal stress results from temperature differences.

Figure 8:
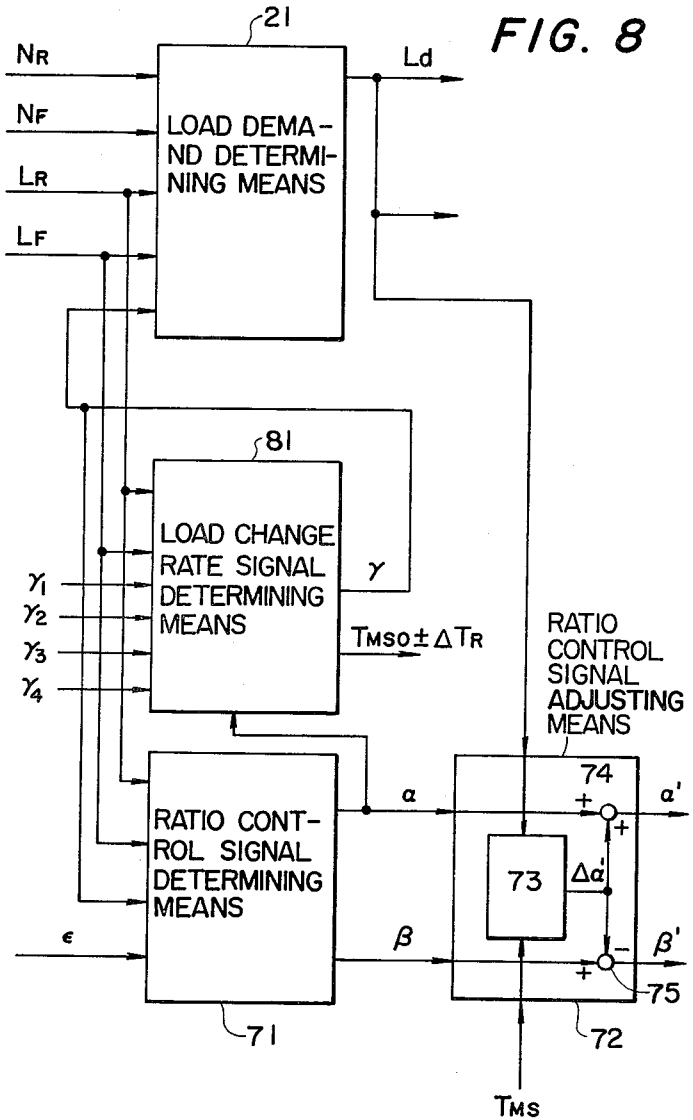
FIG. 8 is a simplified schematic diagram of part of a further embodiment of the invention shown in correspondence to FIG. 1.

In an application of the invention, the rated steam temperature of the steam generator in such case is tentatively reduced by $\Delta T_R$, as indicated at $T'_{MSO}$, to cause variation of steam temperature in a manner as shown by line 92' for causing variation of first stage temperature in a manner as shown by line 93', and the ratio control signal $\alpha$ for the full-arc admission mode is corrected to compensate the temperature reduction to values of line 93' so that the locus of the first stage temperature coincides with the line 48, thus permitting undesired thermal stress to be suppressed. FIG. 8 shows a schematic diagram showing the essential part to this end.

The construction shown in FIG. 8 is similar to that of FIG. 1 except for the fact that performance of the additional load change rate signal determining means 81 is improved such that it can produce a command for correcting the rated steam temperature with respect to the steam generator and also that a ratio control signal adjusting means 72 is newly added. Here, $\pm\Delta T_R$ are provided as a change in rated steam temperature, and this is because while in the previous example of load increase a change of $-\Delta T_R$ along line 48 has been required, in the converse case of load reduction along line 46 a change of $+\Delta T_R$ is required.

Figure 9:
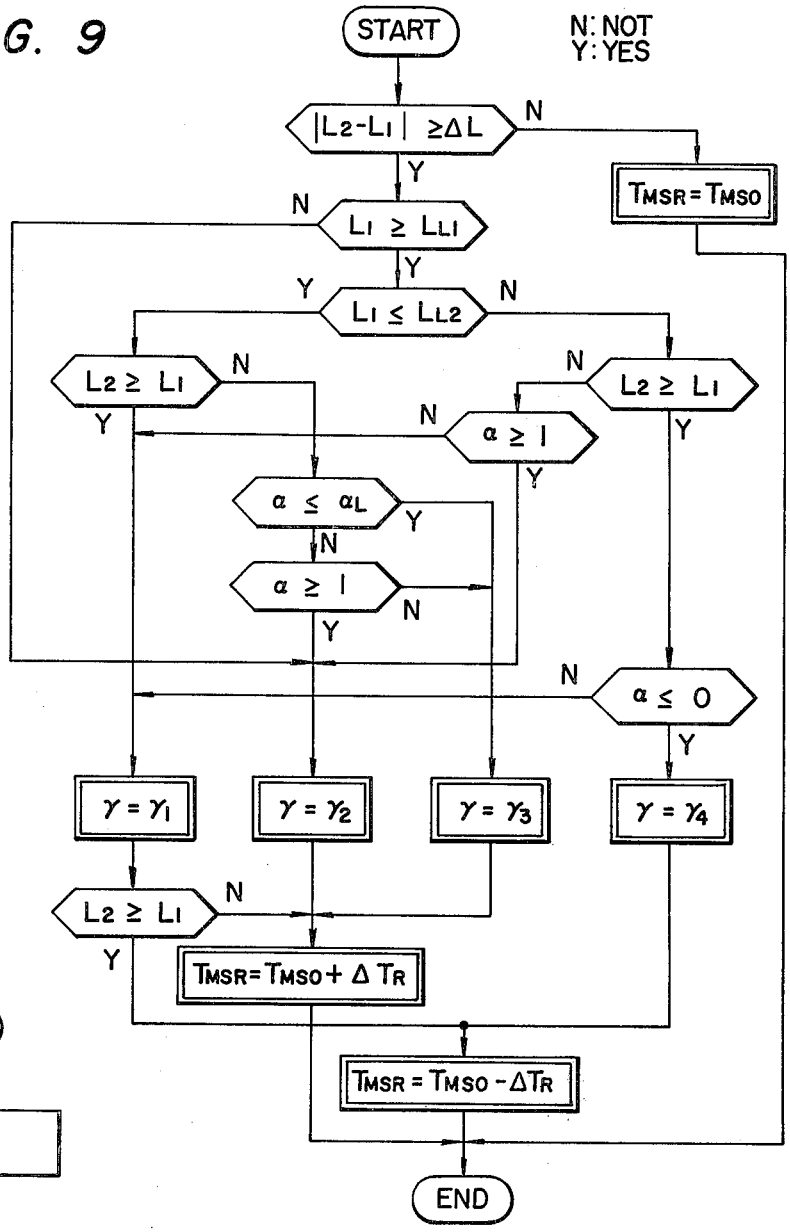
FIGS. 9 and 10 are views illustrating the principles underlying the process in an important part of the system of FIG. 8.
Figure 10:
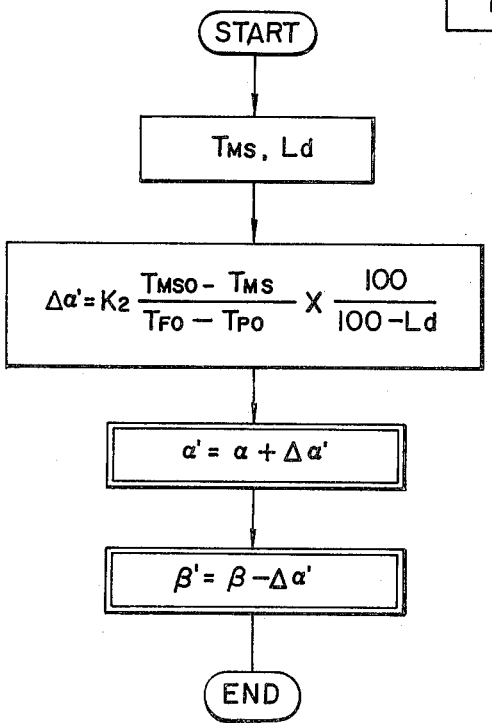

The signal $T_{MSO'}$, which is equal to $T_{MSO} \pm \Delta T_R$, is given to the steam generator control means (not shown) as the steam temperature set point as shown, e.g., in U.S. Pat. No. 3,310,683. FIG. 9 shows the logic construction required for the means 81 in this case. In the ratio control signal adjusting means 72, the outputs $\Delta$ and $\beta$ of the ratio control signal determining means 71 are coupled to respective adders 74 and 75 for adjustment to $\Delta'$ and $\epsilon'$ respectively in the presence of a correction signal $\Delta\beta'$ which is calculated from the load demand signal $L_d$ and output $T_{MS}$ of a steam temperature detector (not shown) provided at an output portion of the steam generator by an equation $$\Delta\alpha' = K_2 \frac{T_{MSO} - T_{MS}}{T_{FO} - T_{PO}} \times \frac{100}{(100 - L_d)} \tag{18}$$

$$\alpha' = \alpha + \Delta\alpha', \beta' = \beta - \Delta\alpha' \tag{19}$$

Here, $T_{FO}$ and $T_{PO}$ are those shown in FIG. 4a.

Figure 11:
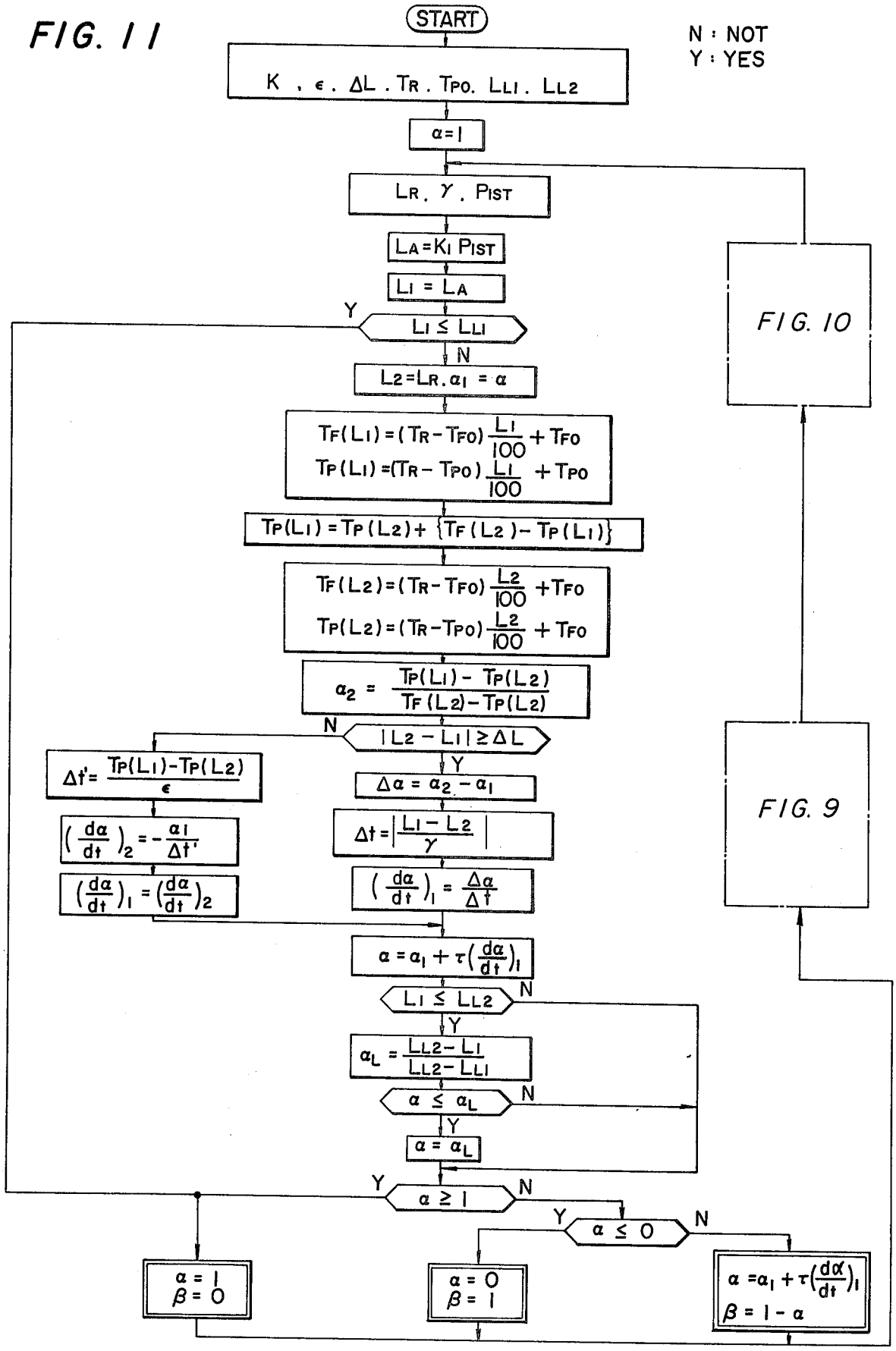
FIG. 11 is a general flow chart in case of employing a programmed digital computer for realizing all the functions involved in the afore-mentioned embodiments of the invention.

As has been shown, the invention can be realized by means of suitable hardware. However, since this requires a very complicated system, it is far better to employ a programmed digital computer, and FIG. 11 shows a general flow chart in such case.

Figure 6:
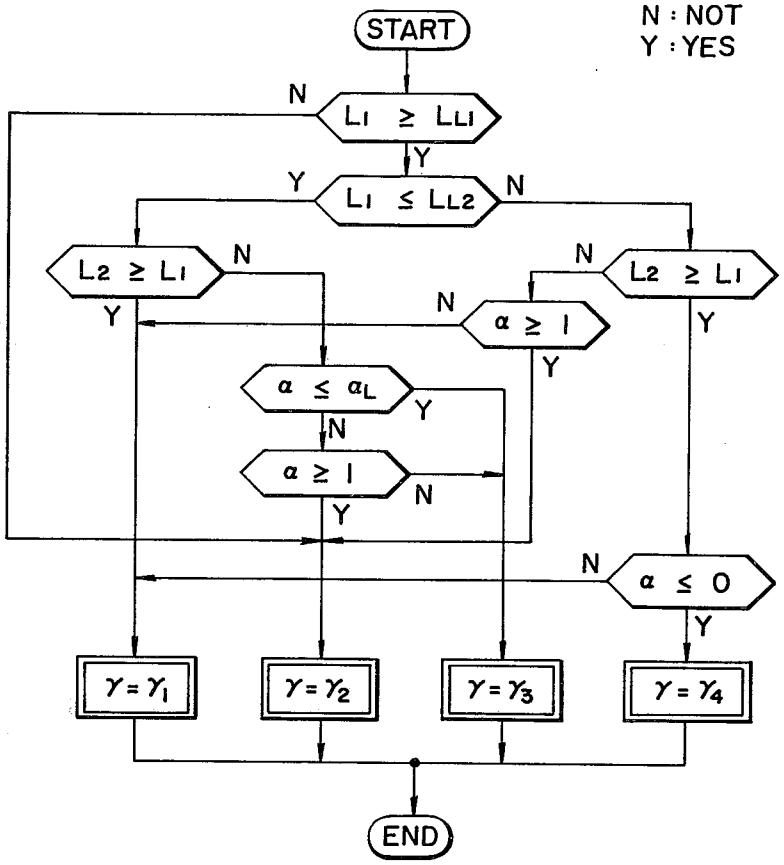
FIG. 6 is a flow chart showing the principles underlying the process in an important part of the system of FIG. 5.

While the foregoing embodiments of the invention have concerned with a public power plant system, the invention can be directly applied to private power generation equipment connected to an independent load as well. Further, it is applicable not only to the power generation equipment but also to mechanical drive steam turbines such as those for petroleum pipe line pumps and ships. Furthermore, while the above embodiments have each used four control valves, it is apparently possible to use no less than two valves for carrying out the invention. Still further, while according to the invention the first stage pressure $P_{1\text{-}st}$ is detected as turbine load and is converted thereto for use, it is also possible to use direct measurements of the generator load although with slight sacrifice in precision. As a further alternative, since the time constant of response to turbine load is comparatively short, typically less than 10 seconds, it is possible to obtain sufficient effects of the invention by substituting the output of the pattern generator 31 for the load demand signal $L_d$ for calculation by equation (18). Further, while insensitivity band $\Delta L$ is provided with respect to the difference between turbine load $L_A$ and load reference $L_R$, by controlling the magnitude of this $\Delta L$ sensitivity adjustment through FA/PA co-operation control is possible. For example, by setting the $\Delta L$ to be greater than the governer free width there is no need of responding to turbine load fluctuations due to system frequency fluctuations. Further, the line 5 provided for limiting the admission mode under low load need not be a straight line between the two output levels $L_{L1}$ and $L_{L2}$, and it is possible to use a curved limiting line by taking the turbine efficiency and the extent of local heating into consideration to obtain the effects of the invention without altering the essential nature thereof. Further, although the first stage steam temperature characteristics are linearly approximated as by lines 46 and 48 with respect to the turbine load $L_A$, the actual characteristics are non-linear, so in case if FA/PA co-operation control of high precision is required the non-linear characteristics may be used in place of equation (5) and (6). Moreover, as the logic determining function for selectively setting the rate of load change the sequence in the embodiment of FIG. 6 is not always necessary, and it is only necessary to be able to obtain mode determination for the locus traced by the first stage steam temperature.

We claim:

1. In a steam turbine control system having a turbine and a plurality of valves operable to admit steam to a first stage of the turbine through a nozzle arc, the combination of:

means for generating a load demand signal according to a speed reference signal, speed feed-back signal, load reference signal, load feed-back signal, and load change rate signal:

means for generating a first valve opening signal under a full arc admission mode according to said load demand signal;

means for generating a second valve opening signal under a partial arc admission mode according to said load demand signal;

means for generating first and second ratio control signals between steam flow under the full arc admission mode and steam flow under the partial arc admission mode according to the load reference signal, the load feed-back signal, the load change rate signal, and a first stage temperature change rate signal;

means for adjusting the said first valve opening signal according to said first ratio control signal;

means for adjusting the said second valve opening signal according to said second ratio control signal; and load control means arranged to position said valves to admit a desired total steam flow to said turbine according to the adjusting valve opening signals.

2. The combination according to claim 1 wherein said second ratio control signal is limited under predetermined low turbine load.

3. The combination according to claim 1, further comprising, means for determining said load change rate signal according to the load reference signal, the load feedback signal, the first ratio control signal and a plurality of predetermined load change rate signals.

4. The combination according to claim 3, further comprising, means for adjusting the steam temperature of the steam generator furnishing steam to said turbine.

5. In a steam turbine control method having a turbine and a plurality of valves operable to admit steam to a first stage of the turbine through a nozzle arc, the steps comprising:

determining the load demand on the basis of a speed reference signal, speed feedback signal, load reference signal, load feed-back signal, and load change rate signal;

determining a valve opening under full arc admission mode according to said load demand;

determining a second valve opening under partial arc admission mode according to said load demand;

determining a first and second ratio between the steam flow under the full arc admission mode and the steam flow under the partial arc admission mode according to the load reference signal, the load feed-back signal, the load change rate signal, and first stage temperature change rate signal;

adjusting the said first valve opening according to said first ratio;

adjusting the said second valve opening according to said second ratio;

adjusting said valves to admit a desired total steam flow to said turbine according to the adjusted valve opening values.

6. The combination according to claim 5, wherein said second ratio is limited under predetermined low turbine load.

7. The combination according to claim 5, further comprising the steps of:

determining the load change rate according to the load reference signal, the load feedback signal, the first ratio, and a plurality of predetermined load change rate signals.

8. The combination according to claim 7, further comprising the steps of:

adjusting the steam temperature of the steam generator furnishing steam to said turbine.

* * * * *